United States Patent [19]

Glasgow

[11] 4,330,225

[45] May 18, 1982

[54] SYSTEM FOR ENTRENCHING SUBMERGED ELONGATED STRUCTURES

[75] Inventor: James S. Glasgow, Huntington Beach, Calif.

[73] Assignee: Santa Fe International Corporation, Orange, Calif.

[21] Appl. No.: 78,184

[22] Filed: Sep. 24, 1979

[51] Int. Cl.[3] ..... E02F 5/02

[52] U.S. Cl. ..... 405/160; 405/162; 405/163

[58] Field of Search ..... 405/157, 159–164

[56] References Cited

U.S. PATENT DOCUMENTS

| | | | |
|---|---|---|---|
| 2,992,537 | 7/1961 | Callahan | 405/163 |
| 3,583,170 | 6/1971 | DeVries | 405/162 |
| 3,751,927 | 8/1973 | Perch | 405/162 |
| 3,786,642 | 1/1974 | Good | 405/163 |
| 3,877,238 | 4/1975 | Chang et al. | 405/162 |

*Primary Examiner*—William F. Pate, III

*Attorney, Agent, or Firm*—LeBlanc, Nolan, Shur & Nies

[57] ABSTRACT

A system for excavating a trench in the sea bottom and removing the excavated spoil from the trench in order to enable an elongated structure, such as a pipeline, to settle into the trench is disclosed along with a corresponding method of operating such system. The system includes a sea sled which can be towed along the bottom of the sea and a towing vessel for towing the sled along the sea bottom. The sea sled includes a frame to be disposed over the area in which the trench is to be formed, a fluid jet excavator mounted on the frame and located adjacent to the rear end of the sea sled and a spoil removal mechanism mounted on the frame and located aft of the fluid jet excavator. Both the center of buoyancy and the center of gravity of the sled are located in front of the fluid jet excavator. The towing vessel is coupled to the sled through a tow line connecting mechanism and is coupled in such manner that the effects of any heaving and/or pitching movements of the vessel upon the fluid jet excavator sled are minimized. The spoil removal machanism is appropriately constructed so that the spoil that is removed from the trench is deposited at a sufficient distance from the sides of the sled so as to minimize the possibility of the spoil immediately slipping back into the trench.

76 Claims, 15 Drawing Figures

2
4
6
8
10
12
14
16
18
20
22
24
26
30
32
34
36
38
40
42

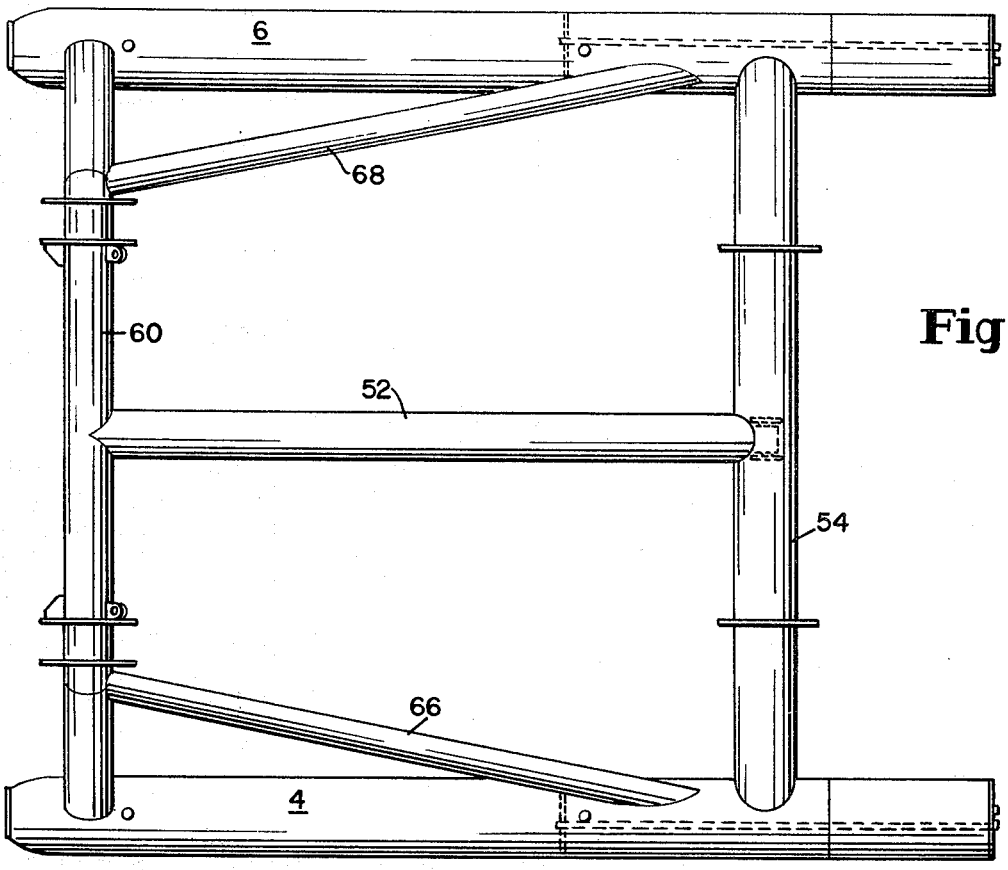
Fig. 10
Fig. 11
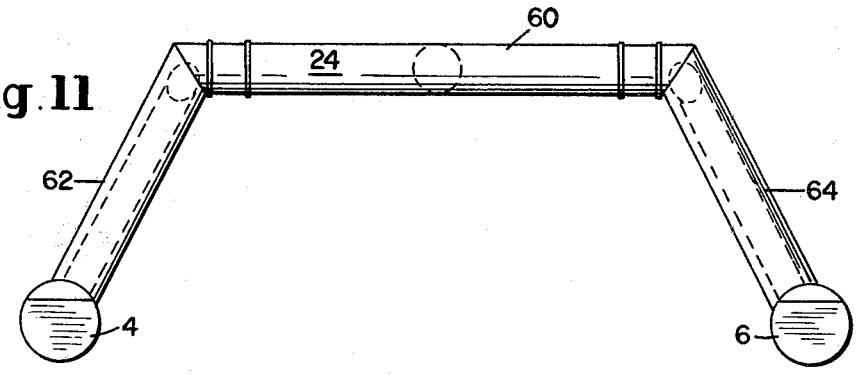
Fig. 12
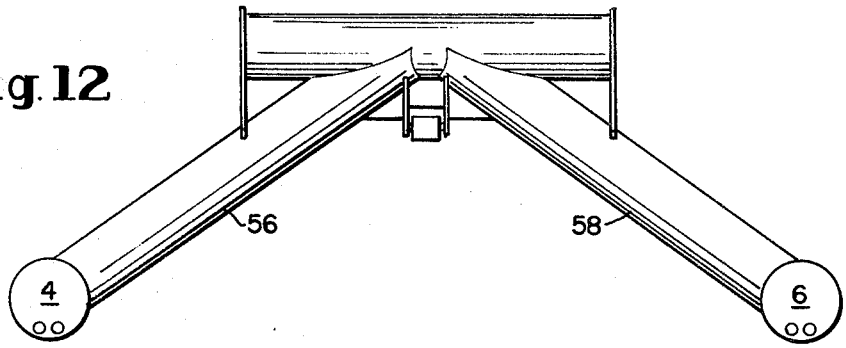

SYSTEM FOR ENTRENCHING SUBMERGED ELONGATED STRUCTURES

RELATED APPLICATIONS AND PATENTS

There are four prior U.S. patents and one allowed pending U.S. application that are related to the subject matter of the present application and are assigned to the same assignee. The patents are: U.S. Pat. No. 3,877,238, issued Apr. 15, 1975 to Nuke Ming Chang and Elmer R. Remkes entitled Sea Sled for Entrenching and Pipe Burying Operations; U.S. Pat. No. 4,025,895, issued May 24, 1977 to Harry H. Shatto and entitled Navigation System for Maneuvering Structure about a Submerged Object; U.S. Pat. No. 4,106,335, issued Aug. 15, 1978 to Harry H. Shatto and entitled Sea Sled Tow Line Vector System; and U.S. Pat. No. 4,112,695, issued Sept. 12, 1978 to Nuke Ming Chang, Elmer R. Remkes and William Cook, Jr. and entitled Sea Sled for Entrenching Pipe. The pending application is Ser. No. 755,733, filed Dec. 30, 1976 and allowed Mar. 8, 1979, in the names of Nuke Ming Chang and Elmer R. Remkes and entitled Sea Sled With Jet Pump for Underwater Trenching and Slurry Removal. The contents of all four of the patents and the pending application are hereby incorporated by reference.

BACKGROUND OF THE INVENTION

The present invention relates to a system for entrenching elongated structures, such as pipelines, on the bottom of the sea.

With the discovery of heavy concentrations of offshore mineral deposits, numerous procedures and equipment have been developed for laying pipelines for transporting the minerals either to shore or to an offshore collection location. The pipelines are connected between the locations and laid along the bottom of the sea.

For the protection of both the pipelines from the surrounding environment and the environment from the pipelines, techniques have been developed for burying the pipelines within trenches along the sea bottom. While various government regulations require that the pipelines be entrenched, the cost of the operation due to various drawbacks with previous trenching equipment has been a significant element in the initial start-up cost. Some of the considerations necessitating trenching of the pipeline are the concerns of protecting the pipeline from damage from storms, mudslides and from entanglement with fishing nets or other large objects being dragged along the sea bottom such as anchors and subsequent damage to the sea due to the leakage in the pipes. The necessity of finding improved techniques and equipment for entrenching the pipelines has been increasingly emphasized over the past several years.

Ideally, a rectangular trench, one having side walls forming a 90 degree angle with the sea bottom, should be formed. However, even in hard clays, it is difficult if not entirely impossible to form such rectangularly shaped trenches. As the trench is cut, a crumbling effect occurs along the side walls, i.e., the side walls cave inwardly thereby causing the walls to slope outwardly. Hence, the realistic goal is to minimize the slope of the side walls, i.e., maximize the angle of repose (the angle of repose is that angle that a side wall forms with a horizontal plane lying along the bottom of the trench). The depth of the trench is generally a minimum of 3 feet plus the diameter of the pipe in order that once the pipe is entrenched, the top of the pipeline lies 3 feet below the plane of the natural sea bottom.

Several different types of trenching devices are presently utilized for entrenching pipelines. Such devices include sea sleds with fluid jet systems, mechanical diggers and mechanically operated plows. The water jet sea sleds are sleds that straddle the pipelines and are dragged along as fluid jets break down the cohesion of the soil. The broken down soil is then removed from the trench by means of eductors. Such sea sleds are described in the above noted Chang, et al. patents. The mechanical diggers are either towed from the surface or self-propelled along the sea bottom so as to move along the pipeline. The mechanical diggers include mechanical cutting devices that actually cut through the soil and carry it off to a location outside of the trench. The third type of system, the mechanical plows also can be either towed from the surface or self-propelled along the sea bottom. The systems merely include shaped members which move along the path of the pipeline so as to plow out a trench in the same manner that a trench would be plowed on the surface.

With all three types of systems, there are several problems that arise during the trenching operation. In order to form a sufficiently sized trench for entrenching the pipeline, it is often necessary to make multiple passes with the trenching equipment over the pipeline. The necessity of multiple passes increases both the costs of the trenching operation and the risk of damage to the pipe. When the equipment is utilized in softer soils, such as fine sand, the trenches often are formed with an extremely small angle of repose. The smaller the angle of repose the greater the chance that the pipe will not be buried with soil due to natural redeposition processes. During the trenching operation, the spoil which is removed from the trench frequently slips back into the trench before the pipe reaches the trench bottom, which increases the number of passes that must be made in order to properly entrench the pipeline. In addition, when trenching in soft soils, such as sand, there is a tendency for the entire trench forming apparatus (e.g., the sled) to be undermined and to ride in the trench. This problem is especially predominant where multiple passes must be made over the pipeline. One further problem that is encountered is the difficulty of properly guiding the trench former over the pipeline due to faulty readings from the sensing mechanism utilized in guiding the sled over the pipeline.

With the fluid jet sea sleds, the broken-up soil is carried off by a spoil removal mechanism. In such arrangements, such as described in the previously noted patents to Chang, et al., the sea sled is provided with jet nozzles directed at sea bottom and jet type eductors. The jet eductors remove the cuttings or slurry, formed by the jet nozzles, from the trench. Such sea sleds can be used in any depth of water including depths exceeding 200 feet. The eductor system as described in the patents to Chang et al. include a pair of suction conduits mounted on a frame work that straddles the pipeline to be entrenched. Each suction conduit has an inlet at its lower end for receiving the slurry formed by the operation of the jet nozzles and a discharge conduit at its other end for discharging the slurry into the ambient water on the side of the trench. The discharge conduit is located so as to discharge the slurry in a direction substantially parallel to the sea bottom on the side of the trench.

During the operation of the fluid jet sea sled, there are several difficulties that are incurred that often necessitate that multiple passes be made over the pipeline in order to form a sufficiently sized trench. During the excavation operation, as the sled moves along the pipeline, a significant portion of the trench may be refilled. It previously had been believed that the refilling of the trench ocurred primarily due to a crumbling or caving effect along the side walls of the trench. In the development of the present invention, it now has been realized that the refilling may be due in large part to the discharge spoil reentering the trench before the pipe reaches the trench bottom. Such refilling of the trench necessitates the makings of multiple passes over the pipeline in order to ensure proper entrenching.

In order to ensure that the soil was adequately broken up the jets expelled from each nozzle have typically been of a relatively high pressure, on the order of 2,000 psi. The utilization of such high pressure fluids, however, significantly increases the cost of providing pumping equipment capable of generating large volumes of such high water pressure for expulsion through the jet nozzles, with this cost being on the order of millions of dollars. In addition, if high pressure fluids are utilized, special tubing must be employed for carrying the high pressure fluids from the vessel down to the jet nozzles while with lower pressure fluids less expensive tubing could be utilized. In addition, when utilizing high pressure fluids in certain types of soft soil, e.g., fine sands, the high pressure jets sometimes can stir up too much of the sand thereby leaving it temporarily suspended in the water and decreasing the effectiveness of the eductor mechanism for removing the soil. In order to compensate for this last problem, it has been suggested that the spacing between the jet tube and eductor be increased by moving the eductor further back on the sled, so that the sand settles before attempting to remove it by the eductors.

Other problems that have been incurred during the operation of the sea sleds have arisen due to the movement of the sled along the sea bottom. If the sled is traveling either too high or too low on the pipeline, then the depth of the trench will vary thereby leading to a cratering or spanning effect of the pipeline as it passes across valleys and other hills on the trench sea bottom. One additional reason for such valleys and hills in the trench is the effect of any heaving or pitching movement of the vessel as it tows the sled along the sea bottom. In addition, if the sled is riding too low on the pipeline or if too wide a trench has been formed, then the sled will sink into the trench thereby rendering the trenching operation increasingly difficult and also causing the bottom of the trench to take a form of a wave.

The mechanical diggers and mechanical plows suffer from some of the same drawbacks and difficulties encountered with the fluid jet sea sleds. During the operation of the mechanical diggers and the mechanical plows, in order to form a properly sized trench, it is necessary for such equipment to make multiple passes over the pipeline. In addition, such equipment must be extremely massive since it is primarily dependent upon the force imparted by the mechanical equipment upon the soil. Hence if the equipment impacts against the pipeline, it can cause severe damage to the pipeline. Furthermore, such equipment is expensive to construct and often must be specifically designed for each type of trenching operation thereby further increasing the cost of the trenching process.

SUMMARY OF THE INVENTION

An object of the present invention is to provide a novel and improved trenching system for entrenching elongated structures under water.

Another object of the present invention is to provide a novel and improved sea sled for entrenching under water pipelines.

A further object of the present invention is to provide a novel and improved sea sled for entrenching a pipeline with a minimum number of passes of the sled over the pipeline while insuring proper formation of the trench.

Still another object of the present invention is to provide an improved trenching system including a towing vessel and a sea sled where any heaving or pitching movement of the towing vessel has a minimum impact upon the trenching operation carried out by the sea sled along the sea bottom.

Still a further object of the present invention is to provide an improved sea sled where the excavated spoil formed by the fluid jet excavator and removed by the spoil removal mechanism is discharged at a sufficient distance from the side of the sled so as to render it unlikely that the spoil will reenter the formed trench before the pipeline reaches the trench bottom.

A still further object of the present invention is to provide a trenching system in which the sea sled moving along the sea bottom can be accurately guided along the pipeline.

In order to achieve the above-noted objectives, numerous substantial modifications have been made in the basic construction of the sea sled in the present invention as compared to previously known sea sleds such as those described in the previously noted patents and applications. Among those modifications are changes in: a basic concept of the construction of the discharge system for removing the excavated spoil from the trench; the constructional arrangement of the sled including the relocation of the fluid jet excavating mechanism and spoil removal mechanism to the rear of the sled structure and simplification of the frame of the sled; the guidance system for guiding the sled and controlling the movement of the sled along the pipeline during operations; and the operation of the fluid jet system by varying the direction of the nozzles and decreasing the pressure of the fluid being expelled from the jet nozzles thereby improving the efficiency of the system and minimizing both the cost of construction and the cost of operation.

In developing the sea sled of the present invention, it was realized that the spoil expelled from the discharge tubes attached to eductors almost immediately fell along an essentially vertical downward path to the sea bottom at a location adjacent to the end of the discharge tube. Previously it had been presumed that if a sufficient discharge force was provided that the material expelled from the discharge tube would be projected along the path so as to be deposited on the sea bottom at a sufficient distance from the side of the sled so as not to reenter the trench. In order to adequately insure that the spoil does not reenter the trench, the discharge tubes on the sea sled of the present invention extend a sufficient distance from the side of the sled so that the tubes lie over the location intended to be the center of the spoil pile. For this purpose, the discharge tubes should extend past the sides of the sled a distance which is a function of the volume of the spoil to be removed from the trench.

Since the jets can excavate an area extending several feet, especially in fine sands, when the fluid jet breaks up the soil along the sea bottom, there is tendency for the pontoons of the sled to sink into the trench being formed. In prior sleds, the fluid jet excavating tubes and the spoil removal eductors have been placed approximately at the center of the sled. Consequently in the operation of such prior sleds as the trench was formed, the entire sled often was undermined and sank into the trench. In order to insure that at least a portion of the pontoons remain on top of undisturbed soil and hence that the entire sled is not undermined, both the fluid jet excavating tubes and the eductors are placed approximately adjacent to the rear end of the sled structure. While previously the eductors had been placed toward the front of the sled structure so that the pontoons would act as a barrier against the spoil slipping back into the trench, due to the extended length of the discharge tubes this is no longer necessary or desirable. By placing the jet tubes and the eductors at the rear of the sled, improved control over the formation of the trench can be obtained.

Due both to the arrangement of the jet tubes and the eductors adjacent to the rear end of the sled and by the inclusion of an improved guidance mechanism and towing arrangement, it is possible to minimize any negative effects upon the completion of a proper trenching operation that often occurred with prior sleds from heaving or pitching movement of the vessel as it towed the sled along the sea bottom. Since the vessel is coupled to the front of the sled, any such movements of the vessel causes the sled to pivot about its rear end. When the jet tubes and eductors are located in the center of the sled they are constantly being lifted and falling back into the trench. By arranging the jet spray tubes and eductors at the rear of the sled, however, any vertical movement of the tubes and eductors will be minimal. In addition, the inclusion of an improved guidance mechanism enables better feedback information to be provided to the vessel for controlling the operation of the sled as it moves along the pipeline.

If desired, with the sled of the present invention, the pressure of the fluid expelled from the jet nozzles can be decreased, thereby making it possible both to decrease the cost of construction and the cost of operation of the trenching system. Although the higher fluid pressures are preferable in excavating in harder soils, in order to use high pressure fluid on the order of 2,000 psi and above, additional pumps and high pressure fluid hoses are required. In addition, the utilization of such high pressure fluids in soft soils, e.g., fine sands can cause a high level of turbulence in the soil and hence the soil does not resettle sufficiently for removal by the eductors, thereby necessitating additional passes to be made over the pipeline for proper trenching.

In accordance with an embodiment of the present invention, the trenching system includes a sled structure that is to be towed along the sea bottom for removing spoil in order to form a trench and a towing vessel for towing the sled structure along the sea bottom. During operation, the frame of the sled structure is disposed over the area in which the trench is to be formed. Thus when forming a trench to entrench a pipeline, the frame travels along the pipeline and straddles the pipeline. Mounted on the frame are a fluid jet excavating mechanism and a spoil removal mechanism, with both of these mechanisms being located adjacent to the rear end of the sled structure. The spoil removal mechanism is located behind the fluid jet excavating mechanism.

The sled structure should have its center of buoyancy and center of gravity located well forward of the fluid jet excavating mechanism both when the sled is in and out of the water. This helps to insure that the entire sled does not slip into the trench during the excavating process. When the sled is out of the water, the center of gravity of the sled should be to the rear of the geometric center of the sled so that the front end of the sled tilts slightly upwardly in order to facilitate transfer of the sled from the deck of the vessel to the water surface. Preferably when lifting the sled to the deck of the vessel, the front of the sled should be raised 5° to 10°.

The towing vessel is coupled to the sea sled by a tow line connecting mechanism that is located at the forward upper end of the sled structure. By coupling the tow line to an upper support brace of the frame, the pulling forces can be directly transferred to the jet tubes and eductors thereby simplifying the frame assembly. By towing the sled from a high towing point this tends to keep the sled righted while the use of a low towing point would tend to lift the bow of the sled. Furthermore, since the fluid jet excavator and spoil removal mechanisms are located at the rear, the vertical positioning of these mechanisms within the trench will not vary significantly due to any heaving or pitching movement of the vessel thereby minimizing the effects of such movement upon the trenching process.

The sled structure includes two pontoons, each of which is provided with a sufficiently high mass concentrated at its front end to balance the weight of the jet tubes and eductors. Thus the sled structure can be provided with a center of gravity either at or preferably slightly to the rear of the longitudinal center of the sled structure when the sled is out of the water. As the sled is lowered through the water, by appropriately ballasting the front ends of the pontoons the center of gravity can be moved forward towards the front of the sled. Shifting the center of gravity forward helps to ensure that the sled will retain a horizontal position during a trenching operation, as long as the center of gravity lies over an untrenched area. In this manner, the rear end of the sled is prevented from sinking into the trench being formed.

Both the fluid jet excavator and the spoil removal mechanism are arranged on a pivotable assembly so that they are pivotable about the front end of the sled structure. By pivoting the pivotable assembly, the fluid jet excavator and spoil removal mechanism are capable of being vertically adjusted with respect to the sled structure.

In order to insure that the spoil removed from the trench is deposited at a sufficient distance from the side of the sled structure so that immediate reentry of the spoil into the trench is unlikely, the length of the discharge tubes should be significantly longer than those of the prior art. For this purpose, preferably for best results, the discharge tube connected to each eductor of the spoil removal mechanism having two eductors should extend past the side of the sled structure by approximately a distance L where:

$$L \geq \sqrt{20\,wd}$$

where w equals the anticipated average width of the trench to be excavated and d equals the approximate depth of the trench to be excavated. If only a single eductor is utilized, then the length of the discharge tube should be even longer.

It has been found that during the soil excavating operation the extent of penetration of the fluid jet into the soil is extremely limited with harder soils, such as clay. Thus while the jet might penetrate weak sand for a distance of several feet, the penetration in hard clays can be under one foot. While increasing the expulsion pressure will increase the penetration, the relationship is far from linear. The penetration will not increase substantially with increases in the pressure. As the jet penetrates the bottom of the front wall of the trench, the wall will cave in to some extent so that the upper part of the wall slopes away from the sled. Consequently, the nozzles at the top of the jet tube serve very little, if any, function since the pressure of the jet spray significantly diminishes as it passes through the water to the front wall. In order to improve the excavating operation, the top of the jet tube can be leaned towards the forward end of the sled so that the nozzles are closer to the front end of the trench being formed. In addition, a heavier concentration of the nozzles are placed at the lower portion of the jet spray manifold tube. By employing such arrangements of the jet tubes, it is then possible to reduce the pressure of the fluid expelled from each of the nozzles, such as, for example, to a level below 1500 psi.

In order to improve the guidance of the sled along the pipeline, a mechanism for determining the relative angular and vertical positioning of the sled structure to the pipeline being entrenched is provided. This position-determining mechanism also includes a warning system for generating a warning signal when the upper portion of the sled system comes into contact with the pipeline. The position determining mechanism includes a plurality of load cells that are housed within cylindrical casings. The cylindrical casings serve as rotational axles for guide rollers mounted on the frame of the sled. These guide rollers help guide the sled along the pipeline. The load cells are responsive to the pressure of the pipeline on the guide rollers, with such response being dependent upon the location of the pipeline to the guide rollers thereby providing improved information concerning the relative positioning of the sled structure along the pipeline. Such improved information can be utilized for enabling better guidance of the sled structure along the pipeline.

When excavating in extremely hard soils, it is believed that even when utilizing jet tubes located on both sides of the pipeline, that the fluid might not sufficiently penetrate the soil so as to excavate the soil under the pipeline thus leaving a soil mound and preventing the pipeline from settling into the trench. This situation might occur where all of the nozzles are facing in a substantially forward direction. If the soil is hard enough, then it is possible that there will not be a sufficient breakdown in the cohesion of the soil so as to undermine the pipeline. In order to overcome this possibility, a limited number of inwardly facing nozzles can be provided along each of the jet tubes. The inwardly facing nozzles would serve to undermine the soil directly under the pipeline. Consequently, each of the jet tubes also would serve to excavate the soil directly under the pipeline. Alternatively, each of the jet tubes could be provided with an L-shaped portion that can be pivoted into a position under the pipeline after the sled has been placed in a position so as to straddle the pipeline. This pivoting action can be actuated by the forward force applied by the towline to the sled. With such an alternative embodiment, once the tubes are pivoted under the pipeline, all of the nozzles would then face in a forward direction, i.e., the direction of movement of the sea sled structure. After the excavation operation has taken place, upon lifting of the sled by the towing vessel, the force applied by the lift wires from the vessel to the sled can be used for actuating a mechanism for causing the jet tubes to be pivoted back into their withdrawal position where the L-shaped portions face in a forward or backward direction.

In order to provide for additional information for controlling the operation of the sled along the sea bottom, within each of the discharge tubes of the spoil removal mechanism, a flow detector and density detector can be provided. Thus, if it is determined that the flow is either too low or too high or the density of spoil in the slurry is either too low or too high, the speed of the sled or pressure of the fluid supplied to the fluid jet excavator and/or the eductors can be appropriately varied. Ideally, the fraction of spoil in the slurry should be on the order of approximately 20% by volume.

In order to vary the depth of the trench being formed, the fluid jet excavator and spoil removal mechanism can be vertically adjusted with respect to the sled. For this purpose, the pivotable frame on which they are mounted can be pivoted through an angle of approximately 8 degrees about the front end of the sled. To allow for additional adjustment, extensions can be coupled to the bottom ends of the jet tube and the eductor. Alternatively, by allowing some ballast to enter the rear end of the sled, it is possible to allow the rear end to slightly tilt into the trench thereby causing the jet tube and eductor to extend to a greater depth in the trench.

In order to improve the stability of the sled as it moves along the sea bottom, the sled should have an underwater weight and not be neutrally buoyant. If the sled is neutrally buoyant then it is more greatly affected by any surface irregularities, small obstacles, oversterring from the vessel and underwater currents. By providing the sled with some underwater weight it is better able to withstand such currents. The weight of the sled ideally should be only great enough so that the pontoons make slight tracks along the sea bottom. The creation of such tracks increases the stability of the sled from moving sideways.

While in the embodiments described, a sea sled structure is shown in which jet tubes and eductors are arranged on both sides of the pipeline to be entrenched. It is possible to use a single jet tube structure. In a single jet tube structure there would be only a single jet tube arranged on one side of the pipeline and either one or two eductors, with the eductors being on same sides. In the utilization of a system having a single eductor, the sled moves more slowly than a sled having two eductors. It is also possible to have a system with two jet tubes and only a single eductor.

The actual eductor system utilized with the sea sled of the present invention is similar to that described in the previously identified Chang et al. patents. Particularly, the eductor system provides a pair of suction conduits mounted on a framework to straddle the pipe to be entrenched. Each suction conduit has an inlet at its lower end for receiving the slurry from the trench and a discharge or eductor conduit section at its other end for discharging the slurry into the ambient water outside the trench. The eductor conduit is located to discharge slurry in a direction substantially parallel to the sea bottom on either side of the trench.

An inner pump nozzle is disposed in each conduit and has an inlet external to the conduit, the inlet being exposed to the ambient water. The outlet of each pump nozzle is disposed within the eductor conduit in a direction toward the conduit discharge. A pair of outer jet nozzles are carried by the sea sled and are mounted coaxially with and behind the inner pump nozzles. Each jet nozzle is located such that its outlet protrudes into the inlet of a corresponding pump nozzle. Each jet nozzle is provided with high pressure low volume fluid from the surface floating vessel. This fluid flows outwardly from the jet nozzle into the larger diameter corresponding pump nozzle to create a low pressure region in the pump nozzle which draws the ambient fluid toward the inlet of the pump nozzle. The jet flow entrains the ambient fluid for delivery through the pump nozzle at low pressure, high volume, into the eductor conduit. This low pressure, high volume, fluid delivery to each eductor conduit creates a suction at the inlets of the conduits whereby slurry from the trench is sucked into the suction conduit, the entrained fluid and slurry being discharged through the eductor conduit. By permitting the high pressure, low volume, jet to expand in the pump nozzle, full use is made of the high energy available in the jet while reducing the pressure and at the same time increasing the flow rate into the primary jet nozzle; there is thus a consequent reduction in the tendency of the eductor conduit to pit as a result of cavitation. It has been found that by utilizing a high pressure, low volume, fluid source pumped from a surface floating tender through each jet nozzle, a low pressure, high volume, condition occurs through the corresponding pump nozzle which, in turn, creates a satisfactory magnitude of suction at the eductor inlets for removal of the slurry.

BRIEF DESCRIPTION OF THE DRAWINGS

FIG. 10 is a plan view of a portion of the frame assembly of the sea sled of the present invention.

FIG. 11 is a forward end view of the front support mechanism mounted on the pontoons of the sea sled shown in FIG. 1.

FIG. 12 is a rear end elevational view of a portion of the frame assembly of the sea sled shown in FIG. 1.

DESCRIPTION OF THE PREFERRED EMBODIMENTS

Figures 1, 2:
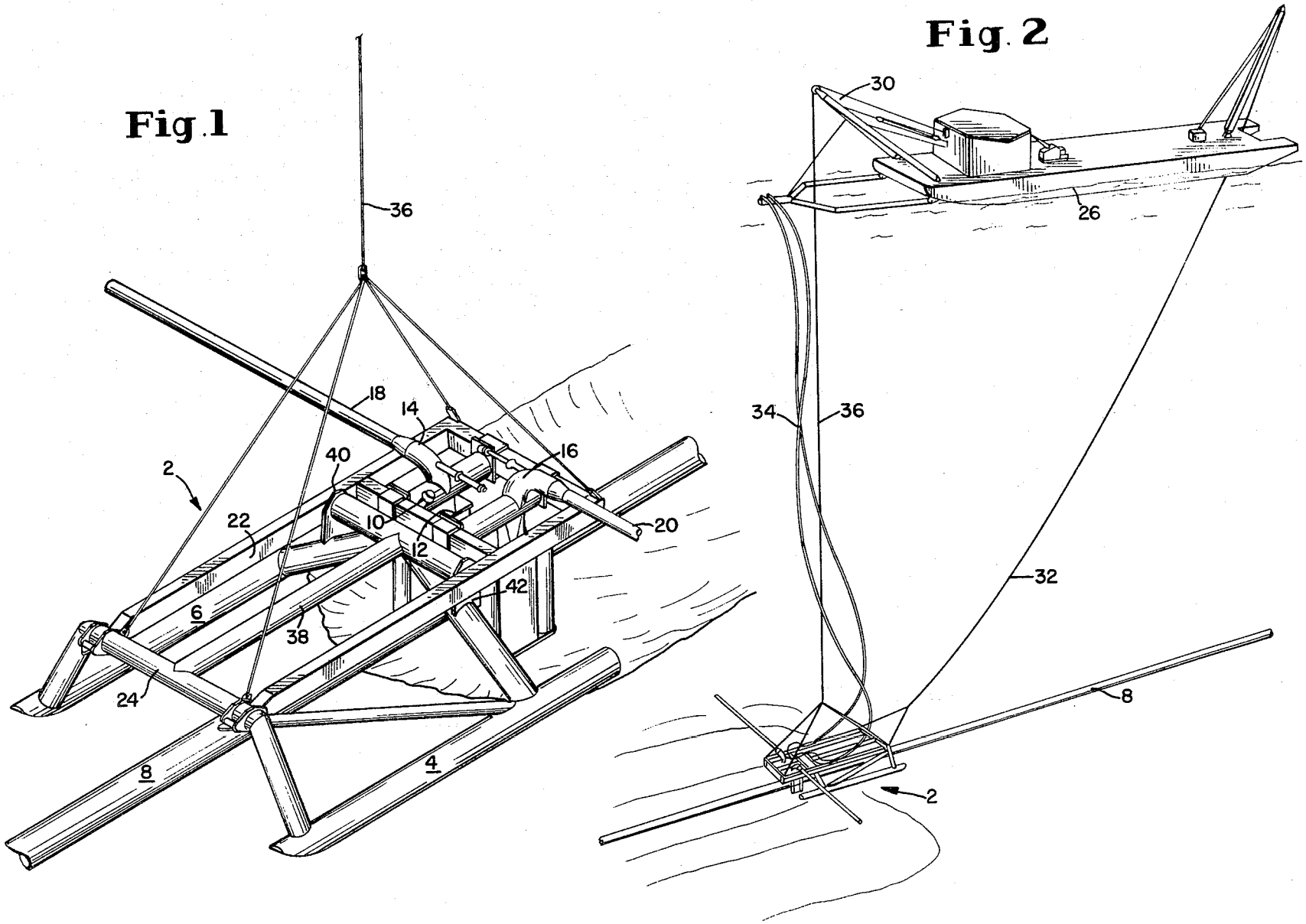
FIG. 1 is a perspective view of a sea sled in accordance with the present invention.
FIG. 2 is a perspective view of a vessel towing the sea sled of the present invention along a pipeline for a trenching operation.
Figure 3:
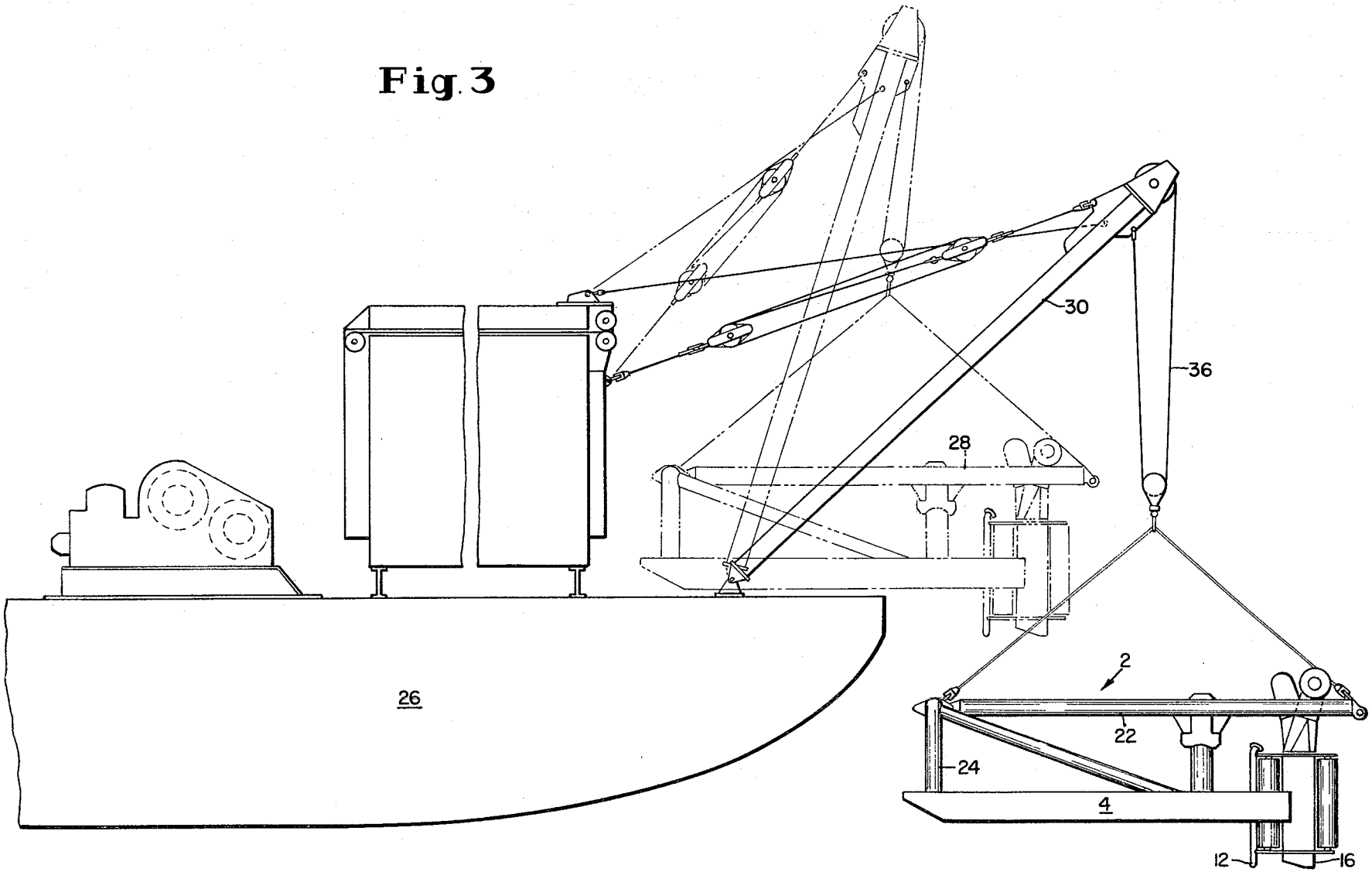
FIG. 3 is a partial side elevational view of a towing vessel and sea sled of the present invention with the sea sled being shown both in a position for lowering it into the water and in a storage position on the vessel.

A sea sled is constructed for being towed along a pipeline 8 laid along the bottom of the sea so that its pontoons 4 and 6 straddle the pipeline, as shown in FIG. 1. During transport to and from the location of the laid pipeline 8, sea sled 2 is held on the deck of vessel 26 such as shown by sled 28 drawn with dashed lines in FIG. 3. Once the vessel reaches the location of the pipeline, the sea sled is lowered through boom 30 by lift wires 36 down to the bottom of the sea. The sea sled is then towed along the sea bottom and pipeline 8 by a vessel 26 through a tow line 32 such as shown in FIG. 2.

Figure 14:
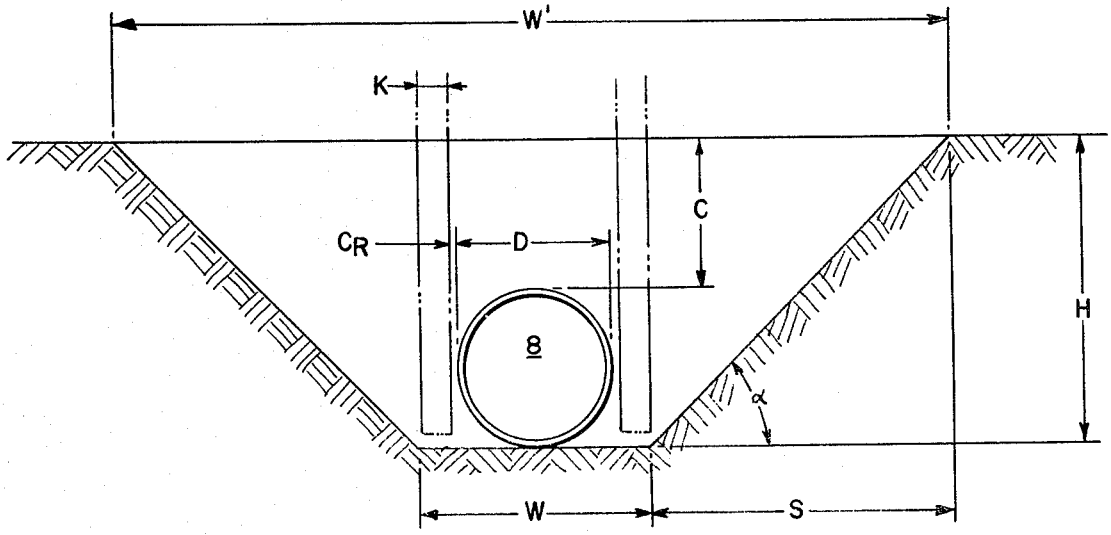
FIG. 14 is a schematic view of a trench formed for entrenching a pipeline.

Turning to FIG. 14, a schematic representation of a pipeline being entrenched is provided. Although pipeline 8 is shown lying at the bottom of the trench with the two claws (combination of the jet tube and corresponding eductor) surrounding the pipeline, such an illustration is merely for representational purposes. In actuality, due to the rigidity of the pipe, the pipeline settles to the bottom of the trench at some distance behind the sled depending on the pipe diameter, typically about 150 to 200 feet. In the illustrated trench, the pipeline to be entrenched has a diameter D, which is the outer diameter of the pipeline including the coatings. The pipeline is to be entrenched by a sufficient depth so as to be covered by a layer of soil having a depth of C. Hence the total desired depth H of the trench is D plus C. As previously mentioned, the sidewalls extend outwardly and thus have an angle of repose $\alpha$ as illustrated. The average width w of the trench is the average of the width at the bottom of the trench W and the width at the top of the trench, or mud line, W'. The width at the bottom of the trench W is equal to the diameter D of the pipeline plus twice the sum of the kerf of the claw K plus the clearance distance of the roller Cr.

Figure 15:
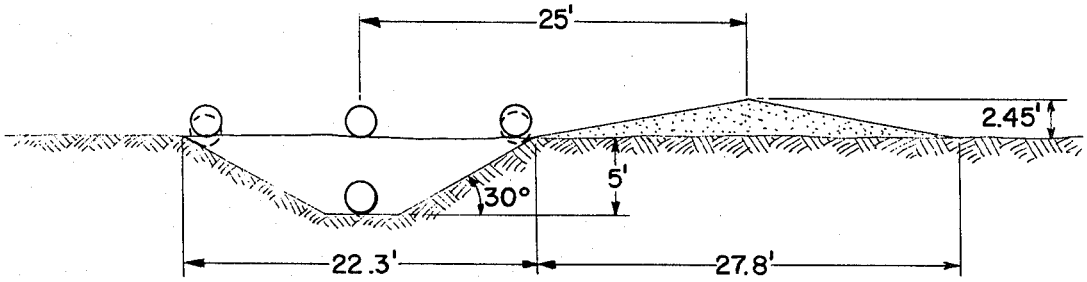
FIG. 15 is a schematic view along the bottom of the sea of a trench and the surrounding area during a trenching operation.

As the sea sled moves along the pipeline, a trench is formed and the excavated spoil is deposited on the side of the trench, such as shown by the schematic illustration in FIG. 15. As shown, the spoil pile is deposited at a significant distance from the sides of the pontoons and the sides of the trench. The distance that the discharge tubes extend should be sufficiently long so that they are approximately located over the center of the spoil pile.

Figure 8:
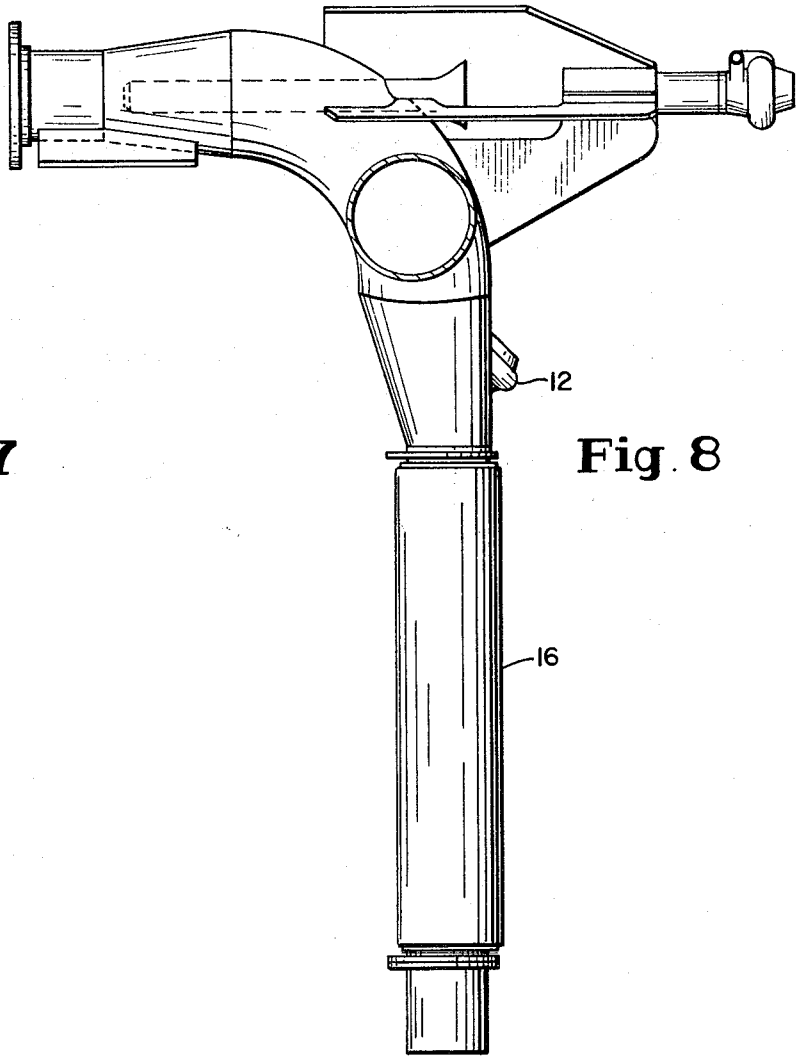
FIG. 8 is a rear elevational view of the eductor assembly utilized on the sea sled of the present invention.

Mounted on sled 2 adjacent to the rear end of the sled are two jet manifold tubes 10 and 12. Behind the jet tubes are two corresponding eductors 14 and 16. Details of the eductor are shown in FIG. 8; these details are described in the previously mentioned patents to Chang, et al. Connected to the output of each of the eductors are corresponding discharge tubes, 18 and 20. The jet tubes serve to provide jet nozzles directed at the soil for excavating by breaking down the cohesion in the soil. The soil slurry is then sucked up by eductors 14 and 16 and discharged to the sides of the sled by discharge tubes 18 and 20. The jet tubes and the eductors with the attached discharge tubes are all mounted on a pivotable frame 22.

In order to ensure that the spoil excavated from the trench does not prematurely slide back into the trench, the length that the discharge tubes extending past the sides of the pontoons must be sufficiently long so as to approximately extend to the center of the intended spoil pile. The location of the spoil pile is determined primarily based on the cross-sectional area of the trench. In determining this area it must be remembered that normally the sides of the trench will not be perfectly vertical but will slope outwardly. Several other factors also effect the formation of the spoil pile, for example, the compactness of the pile. Consequently, the discharge tubes should extend past the sides of the pontoons by a distance L where $$L \geq \sqrt{20\,wd}$$

where w is the average anticipated width of the trench and d is the desired depth of the trench. In accordance with the preferred embodiment of the present invention, the discharge tubes will extend a distance of about 15 feet or more where the distance between the centerlines of the pontoons is approximately 20 feet.

Frame 22 is pivotable about front support brace 24. By pivoting frame 22 the vertical position of the jet tubes and the eductors with respect to the sled can be varied. Prior to lowering the sled into the water, frame 22 is pivoted into a preselected position and secured to brackets 40 and 42 that are attached to a central support frame 38. While the angle through which support frame 22 can be pivoted can vary, in accordance with the preferred embodiment the angle is approximately 8 degrees. If additional vertical extensions of the jet tubes and eductors are necessary, then it is possible to bolt on additional sections to the bottoms of the jet tubes and eductors. The jet tubes and eductors are also horizontally adjustable. The jet tubes and eductors are mounted on supports 70 and 72 and the spacing between these supports is adjustable.

After pivotable frame 22 is adjusted and locked into position, the jet sled is lowered over the stern of the vessel by lowering boom 30 and then lowering guidewire 36 and sled 2 to the bottom of the sea. In order to align sea sled 2 over pipeline 8 so that it straddles the pipeline, a sonar controlled navigating system can be utilized. Such sonar system is disclosed in previously noted U.S. Pat. No. 4,025,895 to Shatto. After the sled is arranged in position so as to straddle pipeline 8, the sled is towed along the pipeline by vessel 26 with the towing force being supplied through connecting wire 32. A stream of high pressure water is fed to the jet tubes and eductors through hoses 34, such as shown in FIG. 2. The water is supplied to the hoses through pump mechanisms on the deck of the vessel.

Figure 4:
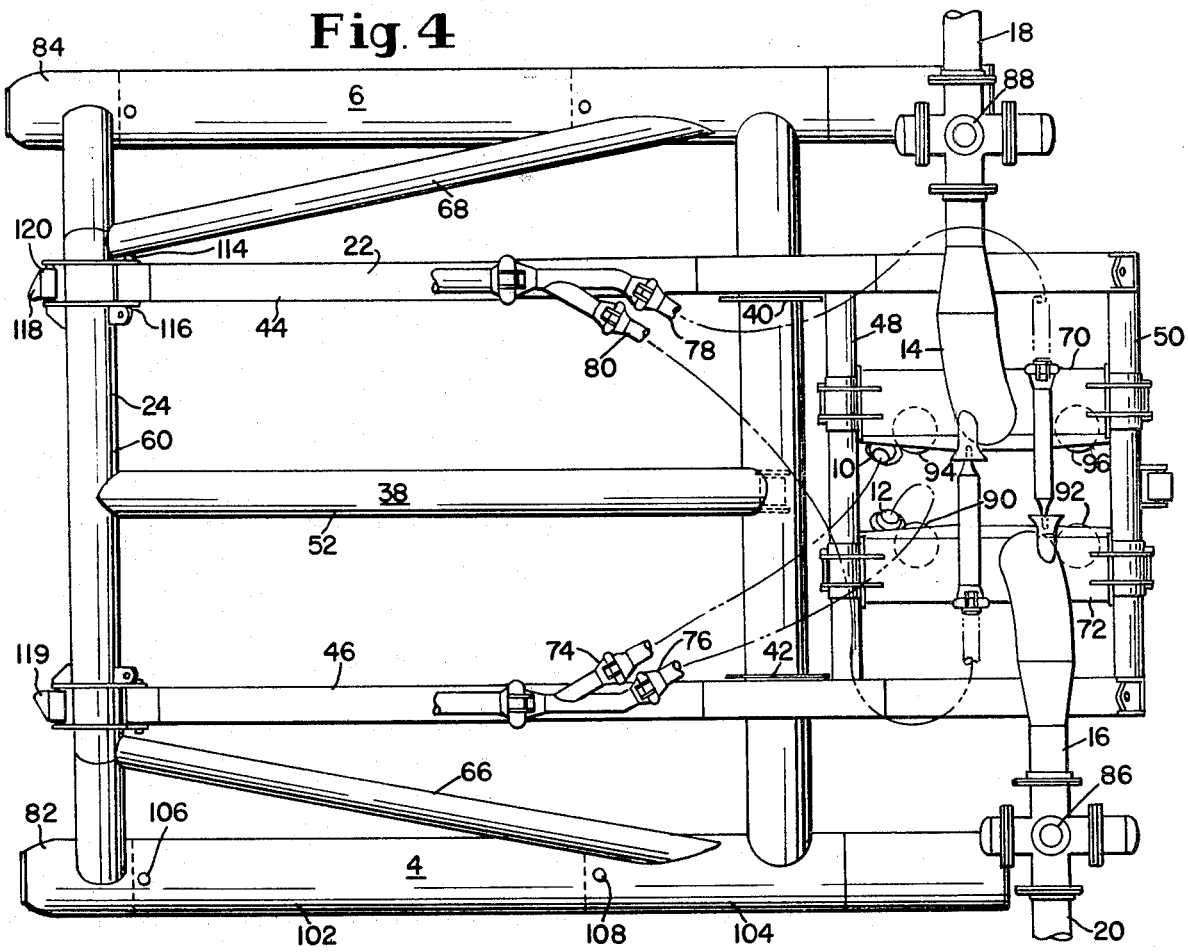
FIG. 4 is a top plan view of the sea sled of the present invention.
Figure 6:
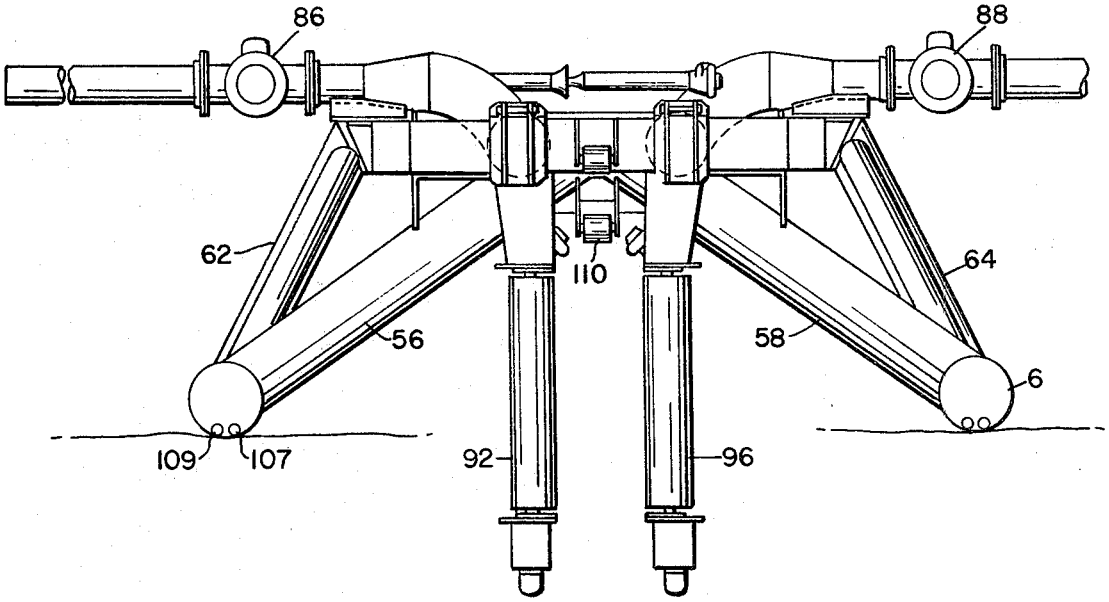
FIG. 6 is a rear end elevational view of the sea sled according to the present invention.

As shown in FIG. 4, pivotable frame assembly 22 includes two arms 44 and 46 and two cross braces 48 and 50 interconnected between the arms. Both arms 44 and 46 are pivotably connected to cross brace 60 of front support frame 24. The front support frame 24 also includes two angular side braces 62 and 64, such as shown in FIGS. 6 and 11. Front support frame 24 serves to interconnect pontoons 4 and 6. Pontoons 4 and 6 also are interconnected by central support 38. Central support 38 includes a longitudinal member 52 and two angular side braces 56 and 58, such as shown in FIGS. 6 and 12. For further stabilization of the frame members with pontoons, additional support braces 66 and 68 are interconnected between cross brace 60 and pontoons 4 and 6, respectively, as shown in FIGS. 4 and 10.

Jet tubes 10 and 12 and eductors 14 and 16 are located in the area bounded between arms 44 and 46 and cross braces 48 and 50. Jet tube 10 and eductor 14 are mounted on a slidable support 70 that is secured between cross braces 48 and 50. Similarly, jet tube 12 and eductor 16 are mounted on a slidable support 72 that also is interconnected between cross braces 48 and 50. The slidable supports are clamped to the cross braces by a clamp members such as clamp 73 shown in FIG. 7. Thus by sliding the two slidable supports, the horizontal positioning of the jet tubes and eductors can be varied in order to enable pipes of different diameters to be entrenched by the sea sled.

Jet tubes 10 and 12 are fed with high pressure water through tubes 74 and 76, respectively, which are connected to one of hoses 34. Eductors 14 and 16 are connected to another one of the respective hoses 34 from vessel 26 through output tubes 78 and 80, respectively.

Figure 5:
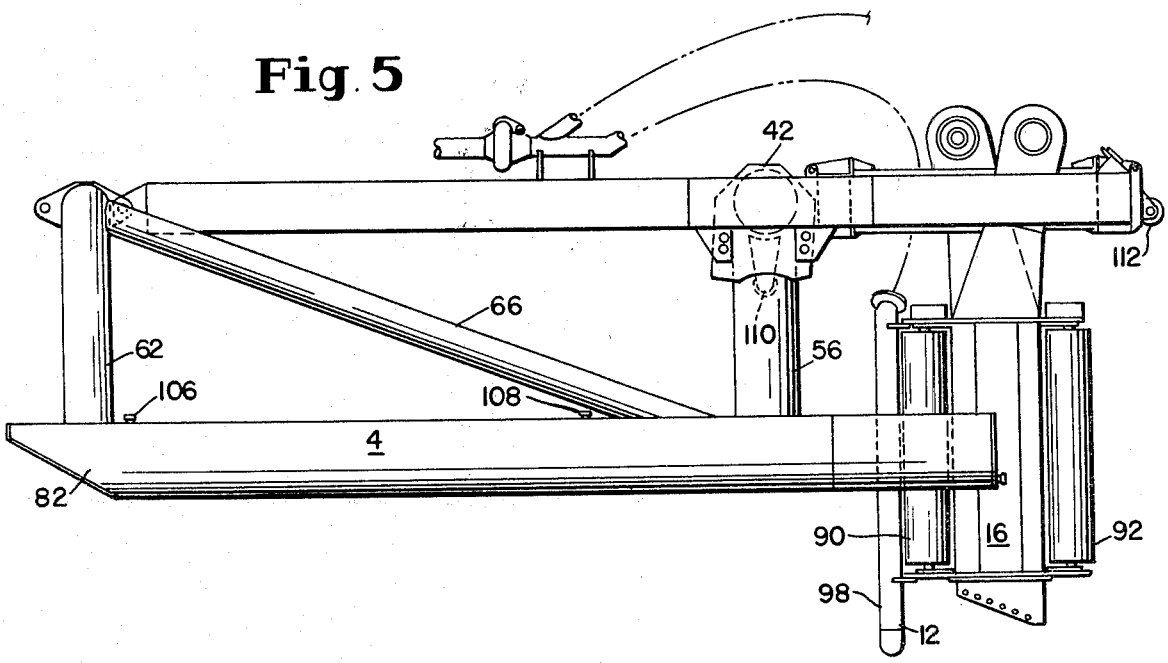
FIG. 5 is a side elevational view of the sea sled of the present invention.

As can be seen from FIGS. 4 and 5, the jet tubes and the eductors are located adjacent to the rear end of the pontoons. In fact, as shown in the drawings, the eductor can be arranged so as to actually extend past the end of the pontoon. Similarly, the jet tubes could be likewise arranged to the rear of the pontoons. By maintaining the jet tubes and eductors at the rear end of the sled, it is possible to prevent the sled from being undermined and sinking into the trench merely by insuring that the forward end of the pontoon always ride on top of an unexcavated area along the sea bottom. Even though the forward end of the trench being formed does slope in the forward direction a distance similar to the distance the trench slopes to each side, with the distance that is provided between the front end of the sled and the jet tubes, the jets rarely have any effect upon the area of the sea bottom below the front ends of the pontoons. Consequently, the front ends of the pontoons should always be riding on top of the unexcavated area.

In order to compensate for the extra weight of the sled at the rear end due to the arrangement of the jet tubes and eductors, the front ends of the pontoon can be filled with a heavy material. Thus, areas 82 and 84 of pontoons 4 and 6, respectively, can be filled with lead or other heavy material. The size of lead weights should be sufficient for balancing the weight of the jet tubes and eductors so that the center of gravity of the sled when it is out of the water is approximately at or slightly to the rear of the geometrical center of the sled. This arrangement of the center of gravity also balances the sled for facilitating its removal from and repositioning on the deck of vessel 26.

By coupling the towline to the sled at a top front section of the sled, this also helps to maintain the stable horizontal orientation of the sled. Such a coupling minimizes the effect of any heaving and pitching of the vessel upon the orientation of the sled.

In order to be able to maintain better control over the trenching operation, it is desirable to provide some type of system for monitoring the removal of the soil slurry from the area being trenched. For this purpose, flow rate and density meters are provided in housings 86 and 88, shown in FIG. 4. These meters constantly monitor the sea water and soil slurry being ejected by eductors 14 and 16. The flow monitor coupled to each eductor measures the flow rate of slurry through the eductor.

The density monitor measures the solid content of the slurry flowing through the eductor. Ideally, the slurry flowing through the eductor should have a 20% solid content, i.e., 20% spoil by volume in the sea water.

The density sensor can be a gamma ray sensor which emits gamma rays that pass through the slurry. The amount of rays which pass through the slurry is then detected. Since the radiation reaching the detector decreases as the slurry density increases, the output of the detector is inversely proportional to the density of the slurry, i.e., the quantity of soil in the slurry. The resulting detector signal can be transmitted to a display panel on board vessel 26.

The flow sensor merely measures the velocity of the slurry through the pipe. The sensor works on the principle that a conductor moving in a magnetic field produces a current. Since sea water is a conductor, the current resulting from the flow of the sea water through a magnetic coil in the eductor provides an indication of the flow rate. The sensor generates a magnetic field which penetrates the slurry. As the slurry flows in this magnetic field, a voltage is generated and that voltage is sensed by detectors; this voltage is proportional to the flow velocity. The output of the detector is also fed to a display console on board vessel 26.

To assist in the guidance of sled 2 along the pipeline, a plurality of guide rollers are provided. These guide rollers include rollers 90 and 92 that are secured to slidable support 72 and guide rollers 94 and 96 that are secured to slidable support 70. In addition to the guide rollers 90, 92, 94 and 96, there are also two top guide rollers 110 and 112. These guide rollers can be clearly seen from FIGS. 4, 5 and 6.

Figure 9:
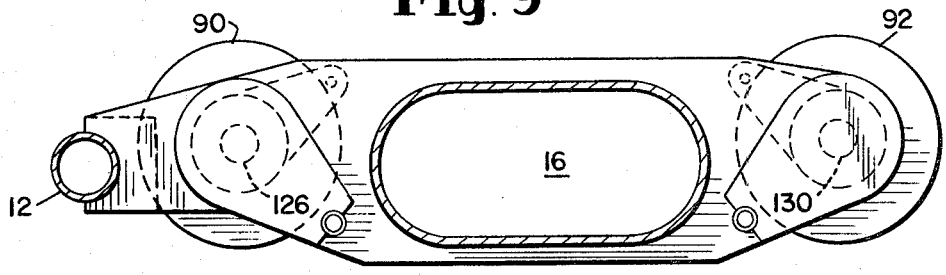
FIG. 9 is a cross-sectional view through lines A—A of FIG. 7.
Figure 7:
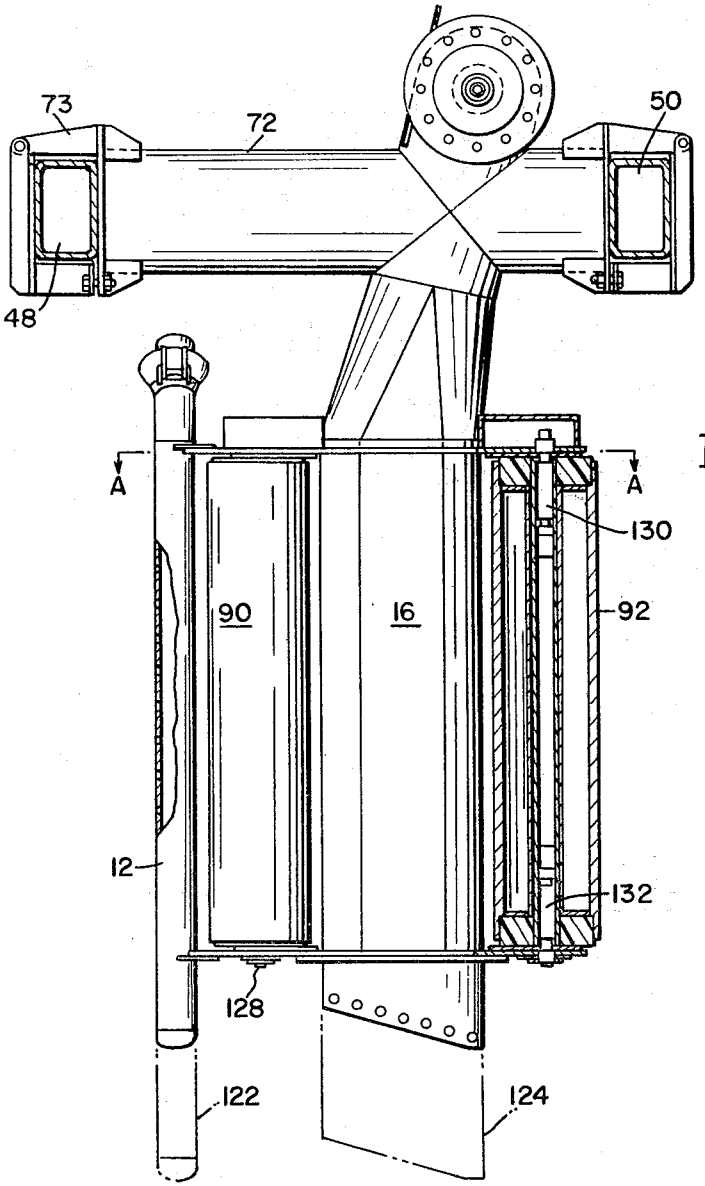
FIG. 7 is a side elevational view of the fluid jet excavator and spoil removal assembly of the present invention.

The guide rollers, in addition to helping guide the sea sled along pipeline 8, by being appropriately constructed in conjunction with a plurality of load measuring devices, or load cells, can serve to provide information concerning the relative position of the sled with respect to the pipeline. For this reason, the axle upon which each of the guide rollers rotates is provided with appropriate load cells. Turning to FIGS. 7 and 9, it can be seen that guide roller 90 rotates about axles 126 and 128, each of which incorporates an appropriate load cell. Similarly, guide roller 92 rotates about load measuring axles 130 and 132. Thus, whenever either of the guide rollers comes into contact with pipeline 8, an appropriate signal will be generated in one or more of the load cells.

Due to the arrangement of the load cells, the signal generated by any one of the load cells is dependent upon how close the pipeline is to the particular cell. Thus, if the sled is riding relatively low on the pipeline, i.e., the pipeline is fairly close to the top of the guide rollers then the signals generated by cells 126 and 130 would be stronger than the signals generated by load cells 128 and 132. In addition, if the sled is skewed with respect to the pipeline, then the pipeline will only touch one of the rollers on each side and hence only generate signals in the corresponding load cells thereby providing an indication that the sled is so skewed. Similarly, if the sled is riding extremely low on the pipeline, then top rollers 110 and/or 112, which also have rotational axles incorporating load cells, will come into contact with the pipeline thereby providing further indication of such orientation of the sled on the pipeline.

Guide roller 110 with its associated load cell will provide such a warning signal when the sled is orientated in a basically horizontal position such as shown in FIG. 5. Guide roller 112 along with its corresponding load cell will serve to provide a warning signal when pivotable support 22 has been pivoted for lowering the eductors and jet tubes. Guide roller 112 also serves to provide a warning signal when the sled is titled with only the front portion of the pontoons riding on top of the soil while the rear end of the sled partially sinks into the trench.

The front face 98 of jet tube 12 is provided with a plurality of jet nozzles which can either protrude from face 98 or be recessed in face 98 for directing the high pressure water at the soil. After the soil is broken up, it is sucked up through openings in the bottom of eductor 16. Similar nozzles and openings are provided in jet tube 10 and eductor 14, respectively. In order to improve the area over which the eductors suck up the excavated soil, the angle over which the openings extend can form approximately a 100° entry cone. The angle of this entry cone can face in a forward direction so as to face in a direction slightly under the pontoons and also under the pipeline being entrenched.

As the sled is lowered into the water, it is possible to increase the weight of the sled by providing each of the pontoons with the capability of taking on sea water as a ballast. For this purpose, each pontoon is provided with two ballast chambers such as chambers 102 and 104 in pontoon 4. Chamber 102 is provided with a vent 106 and a drain 107, such as shown in FIGS. 4, 5 and 6. Chamber 104 is similarly provided with a vent 108 and a drain 109. While both ballast chambers 102 and 104 can be provided with ballast as the sled is lowered into the water, it is generally preferable to block off the openings to chamber 104 and maintain this chamber empty of ballast at all times. By merely taking on ballast in forward chamber 102, the center of gravity of the sled is shifted further forward thereby further insuring that the sled will maintain its horizontal position when the front ends of the pontoon are sliding along upon an unexcavated area. If the rear end of the sled is to be allowed to dip into the trench, which is sometimes desirable for reasons further explained below, then the rear ballast chamber 104 also can be filled with ballast.

In order to make the taking on and expulsion of ballast from the chamber automatic, vent 106 is closed while drain 107 remains open. As the sled is lowered into the water, water enters drain 107 thereby compressing the air within chamber 102. When the sled is subsequently withdrawn from the water, the air pocket expands back towards its original size and expels the water ballast from chamber 102. By expelling the ballast, there is no need to lift the extra weight out of the water.

In order to tow sea sled 2 along the sea bottom, tow line 32 from vessel 26 is connected to the sled at tow line connectors 118 and 119. Each of the tow line connectors contains a load cell such as cell 120. Load cell 120 serves as a pivot axis for tow line connector 118 and secures the connector to a mounting bracket 114. The load cells provide information concerning the towing force being applied to the sled both with respect to the quantity of force and the angle of the force. Mounting bracket 114 is wrapped around cross brace 60. Attached at the other side of bracket 114 is arm 44 of pivotable support 22. Arm 44 is connected to mounting bracket 114 by a pivot axle 116. Since arm 44 is connected to the same mounting bracket as tow line connector 118, the towing force is directly supplied to the mounting bracket and arm 44. Similarly, the towing force is transmitted through connector 119 at arm 46. The force is then transmitted along arms 44 and 46 back to the portion of pivotable frame 22 that supports the jet tubes and eductors. Such a construction allows for the framing of the sea sled to be significantly simplified.

Figure 13:
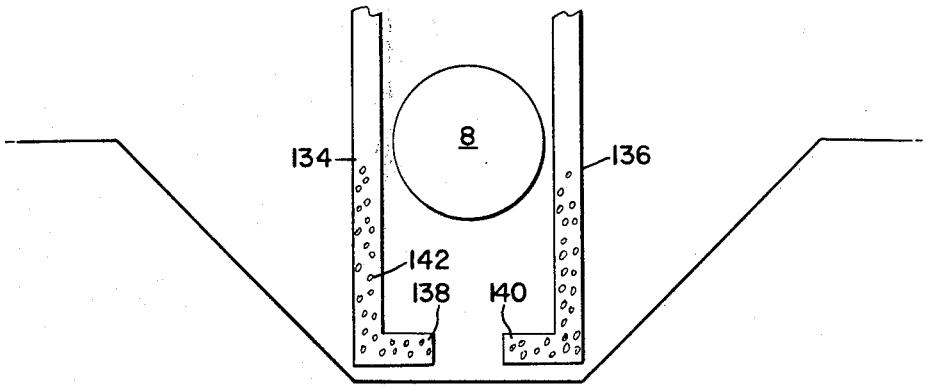
FIG. 13 is a schematic illustration of a portion of a modified embodiment of the present invention.

When utilizing fluid jet sea sleds in excavating hard clays, it is believed that completely vertical jet tubes might not sufficiently excavate the area under a pipeline due to the minimum distance of penetration of the jet sprays in such hard materials. If the area directly under the pipeline is not completely excavated, then a mound of material would remain extending longitudinally along the trench. Such a mound might prevent a pipeline from being properly seated on the bottom of the trench. In order to overcome this potential problem, it is possible to provide horizontally extending sections on the bottom of each of the jet tubes, such as shown in FIG. 13. Thus, each of the jet tubes 134 and 136 has a horizontally extending portion 138 and 140, respectively. Horizontally extending portions of the jet tubes extend under the pipeline so as to fully excavate the soil under the pipeline. In order to enable the jet tubes with their horizontal portions to be placed over pipeline 8, the jet tubes are initially orientated so that horizontal portions 138 and 140 extend in a forward or rearward direction towards the front or back of the sled. After the sled is lowered to the sea bottom to a position over the pipeline, jet tubes 134 and 136 are rotated so that horizontal portions 138 and 140 extend under pipeline 8 and nozzles 142 face in a forward direction towards the front of the sled. The sled is then ready for the trenching operation.

OPERATION

After the pipeline has been laid along the bottom of the sea, a trenching vessel with its sea sled is brought to the location of the laid pipeline and the sea sled is lowered to the sea bottom so as to straddle the pipeline, such as shown in FIG. 2. By moving the vessel in a forward direction a towing force is applied to sea sled 2 through tow line 32. The navigation of vessel 26 is controlled in response to feedback information generated by guide rollers 90, 92, 94, 96, 110 and 112 and the corresponding load cells. Thus, if information is received by the vessel that the sea sled is riding too low on the pipeline, i.e., either top guide rollers 110 and 112 is touching pipeline 8 or the pipeline is located adjacent to the top ends of guide rollers 90, 92, 94, 96, this is indicative of too deep a trench being formed and possibly also the sled tending to sink into the trench. This situation can occur if the sled is moving too slowly along the sea bottom thereby causing too much of the soil surrounding the pipeline to be excavated. Consequently when such feedback information is received by the vessel the speed of the vessel can be increased accordingly. In contrast, if the sea sled is riding too high then the size of the trench being formed is not deep enough and hence the vessel can be slowed down so that more time is taken to excavate the soil around the pipeline. In both situations the presumption is that the operation of the jets and the eductors is maintained at a constant level. As an alternative to controlling the speed of the vessel, the operations of the jet tubes and eductors could be properly modified. The navigation of vessel 26 is also modified in response to signals from the guide rollers indicating that the sea sled is skewed. The orientation of vessel 26 would then be modified so as to realign the force applied through tow line 32 so that the force is applied in a longitudinal direction along pipeline 8.

As sea sled 2 moves along pipeline 8, the jets emitted from the nozzles of jet tubes 10 and 12 penetrate and break up the soil in the area surrounding the pipeline. The pressure of the jets can be on the order of between 700 and 2500 p.s.i. If is possible for the jets to be emitted with a force of approximately 850 p.s.i., which force can be generated by feeding a water flow into the hoses connected to the jet tubes with a pressure at the surface of approximately 1000 p.s.i., depending on water depth. After the soil has been excavated, the soil is removed by the eductors and deposited to the sides of the sled, such as shown in FIG. 15. Since the soil is deposited at a significant distance from the sides of the sled, it is unlikely that any such spoil will slip back into the formed trench. Consequently, it is possible to form an appropriate trench with only a single pass having to be made over the pipeline.

As the excavation process proceeds, by shifting the center of gravity of the sea sled as far forward as possible, by ballasting the forward ballast chambers in each of the pontoons, as long as the front portions of the pontoons remain on an unexcavated area, the sled should be able to retain a horizontal orientation. By so maintaining the sled to prevent it from sinking into the trench, if the rear end of the sled should sink into the trench, then there still is no problem in towing the sled in a forward direction since the front ends of the pontoon remain on an unexcavated area. With prior sleds, the entire sled could be undermined and sink into the trench and hence, in addition to the difficulty of towing the sled through the soil, the front end of the sled could dig into the forward wall of the trench or dip in and out of the trench thereby leading to a plurality of hills and valleys in the formation of the trench.

During certain times of the operation of the trenching system, there might be a desire to form an extremely deep trench. This cn be accomplished either by extending the length of the jet tubes and educators or alternatively allowing the rear end of the sea sled to slightly sink into the trench being formed thereby lowering the depth to which the jet tubes and eductors extend. This orientation can be achieved by ballasting the rear ballast compartment in each of the pontoons. By appropriately controlling the movement of sea sled 2, the forward portions of the pontoons can still be maintained on an unexcavated area thereby avoiding the slipping of the entire sled into the trench.

During the movement of vessel 26 along the water surface, the vessel is often subjected to some heaving and pitching movements due to the waves within the sea. While such movements would be transmitted through tow line 32, the effect upon the operation of sea sled 2 is minimal. When varying the orientation of the force applied to the front end of the sea sled 2, the sled is pivoted about its rear end. Since the jet tubes and eductors are located at the rear end, their vertical spacing with respect to the sea bottom should not significantly change due to any heaving or pitching movement of vessel 26. With prior sleds because the jet tubes and eductors were positioned approximately at the sled longitudinal center and the sled also pivoted about its rear end, such heaving and pitching movements of the vessel would change the vertical positioning of the jet tubes and eductors thereby causing hills and valleys to be formed along the bottom of the trench. The system of the present invention, however, is substantially unaffected by such movements of vessel 26.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. Apparatus for use in excavating a trench in a sea bottom and for removing spoil formed during the excavation, said apparatus comprising:

a base structure capable of being towed along a sea bottom, said base structure including: two pontoons, each having a sufficiently high mass concentrated at its front end so that the center of gravity of said base structure is approximately at the longitudinal center of said base structure when said base structure is out of water; a frame for disposition over the area in which the trench is to be formed; tow line connecting means arranged at the forward section of said base structure; fluid jet excavating means mounted on said frame and located adjacent to the rear end of said base structure; spoil removal means mounted on said frame and located aft of said fluid jet excavating means; said spoil removal means including at least one eductor for sucking up spoil excavated by said fluid jet excavating means and a discharge tube coupled to an output end of said eductor, said discharge tube extending past the side of said base structure by approximately a distance L where $$L \geq \sqrt{20\,wd}$$

where w equals the average width of the trench to be excavated and d equals the depth of the trench to be excavated; and said base structure having its center of buoyancy and center of gravity located so that said base structure rides along substantially undisturbed soil on the sea bottom during the excavating operation; and a towing vessel capable of moving along the water surface and having towing means coupled to said tow line connecting means so that said towing vessel can tow said base structure along the sea bottom.

2. Apparatus for use in excavating a trench in a sea bottom and for removing spoil formed during the excavation, said apparatus comprising:

a base structure capable of being towed along a sea bottom, said base structure including: a frame for disposition over the area in which the trench is to be formed; tow line connecting means arranged at the forward section of said base structure; fluid jet excavating means mounted on said frame and located adjacent to the rear end of said base structure; spoil removal means mounted on said frame and located aft of said fluid jet excavating means; and said base structure having its center of buoyancy and center of gravity located so that said base structure rides along substantially undisturbed soil on the sea bottom during the excavating operation;

a towing vessel capable of moving along the water surface and having towing means coupled to said tow line connecting means so that said towing vessel can tow said base structure along the sea bottom;

said frame includes an assembly pivotable about an axis lying adjacent to a plane along the front end of said base structure and said pivotable assembly extending rearwardly along said base structure; and said fluid jet excavating means and said spoil removal means are attached to said pivotable assembly so taht said fluid jet excavating means and said spoil removal means are vertically adjustable with respect to said base structure.

3. Trenching apparatus according to claim 1 wherein said discharge tube is sufficiently long so as to deposit the spoil created by the operation of said fluid jet excavating means and sucked up by said eductor at a sufficient distance to the side of said base structure so that the spoil is unlikely to immediately reenter the trench being formed before.

4. Trenching apparatus according to claim 1 wherein said fluid jet excavating means includes at least one jet manifold tube having a plurality of output nozzles extending therefrom for directing water towards the surface to be excavated.

5. Trenching apparatus according to claim 4 wherein said discharge tube has its output end sufficiently spaced to the side of said base structure so that said output end lies over the center of the intended spoil pile.

6. A trenching apparatus according to claim 1 or 2 wherein said fluid jet excavating means includes at least one jet manifold tube having a plurality of output nozzles extending therefrom for directing water towards the surface to be excavated.

7. Trenching apparatus according to claim 6 wherein said jet manifold tube can be pivoted so that its upper end leans towards the front of said base structure and the surface being excavated.

8. Trenching apparatus according to claim 6 wherein said nozzles are concentrated near the lower portion of said jet manifold tube.

9. Trenching apparatus according to claim 6 wherein during utilization of said base structure for excavation, the majority of said nozzles face towards the direction of movement of said base structure and some of said nozzles face in a transverse direction towards a plane along the longitudinal axis of said base structure.

10. Trenching apparatus according to claim 6 wherein said jet manifold tube is an L-shape tube having a vertical portion and a transverse portion extending from the lower end of said vertical portion and said nozzles extend along the same side of both said vertical and transverse portions of said jet manifold tube in such a direction that said nozzles face in the direction of movement of said base structure during the excavating operation; and further comprising means for causing said transverse portion of said jet manifold tube to extend along the longitudinl axis of said base structure both before and after the excavation operation and to extend towards a plane along the longitudinal axis of said base structure during the excavating operation.

11. Trenching apparatus according to claim 6 further comprising flow detection means for detecting the flow through said discharge tube and density detection means for detecting the density of the output spoil flowing through said discharge tube.

12. Trenching apparatus according to claim 1 further comprising flow detection means for detecting the flow through sid discharge tube and density detection means for detecting the density of the output spoil flowing through said discharge tube.

13. Trenching apparatus according to claim 2 wherein: said spoil removal means includes at least one eductor for removing spoil excavated by said fluid jet excavating means and a discharge tube coupled to an output of said eductor for depositing the excavated spoil at a distance spaced from the trench that is excavated; said fluid jet excavating means including at least one jet manifold tube having a plurality of output nozzles extending therefrom for directing water towards the surface to be excavated; and said frame including an upstanding support mounted between said pontoons and said pivotable assembly is connected to a top portion of said upstanding support and is pivotable about said upstanding support.

14. Trenching apparatus according to claim 13 further comprising flow detection means for detecting the flow through said discharge tube and density detection means for detecting the density of the output spoil flowing through said discharge tube.

15. Trenching apparatus according to claims 13 or 14 wherein: said fluid jet excavating means includes two jet manifold tubes; said spoil removal means including two eductors and two corresponding discharge tubes, each of said discharge tubes being coupled to an output of said corresponding eductor; each of said jet tubes and eductors being mounted on said frame so as to be capable of being arranged on opposite sides of an elongated member that is to be entrenched in the trench to be formed.

16. Trenching apparatus according to claim 1 wherein each of said pontoons is constructed so as to receive an increasing quantity of ballast when said base structure is lowered through the water to the sea bottom.

17. Trenching apparatus according to claim 16 wherein each of said pontoons expels the ballast received when said base structure is raised from the sea bottom to the water surface.

18. An apparatus for entrenching a submerged elongated structure such as a pipeline in the soil along the bottom of the sea, said apparatus comprising:

a sled structure capable of being towed along the sea bottom so as to straddle the elongated structure to be entrenched for excavating a trench under such elongated structure so that such elongated structure can eventually settle into the trench, said sled structure including: a frame; fluid jet excavating means mounted on said frame and located adjacent to the rear end of said sled structure; spoil removal means mounted on said frame and located aft of said fluid jet excavating means, said spoil removal means including a discharge tube for discharging soil excavated from the trench at a location spaced to the side of said frame of said sled structure, said discharge tube extending a minimum distance dependent upon the volume of soil to be removed from the trench; and said sled structure having its center of bouyancy and center of gravity located so that said sled structure rides along substantially undisturbed soil on the sea bottom during the excavating operation; and a toward vessel capable of moving along the water surface and having towing means coupled to said sled structure so that said towing vessel can tow said sled structure along the sea bottom.

19. Trenching apparatus according to claim 18 wherein said towing means is coupled to said sled structure so as to minimize any effects upon the vertical positioning with respect to the trench of said fluid jet excavating means and said spoil removal means due to any heaving and pitching movements of said vessel.

20. Trenching apparatus according to claims 18 or 19 wherein: the front end of said frame lies approximately adjacent to a plane along the front end of said sled structure; said frame has a towline connecting means at its front end; and said towing means includes a tow cable connected between said vessel and said towline connecting means.

21. Trenching apparatus according to claim 18 further comprising position determining means for determining the relative angular and vertical positioning of said sled structure to the elongated structure being entrenched as said sled structure moves along the elongated structure and warning means for generating a warning signal if said sled structure comes into contact with the elongated structure.

22. Trenching apparatus according to claims 18 or 19 wherein said fluid jet excavating means includes two jet manifold tubes; said spoil removal means includes two eductors and two corresponding discharge tubes, each of said discharge tubes being coupled to an output of said corresponding eductors; and each of said jet tubes and eductors and mounted on said frame so as to be capable of being arranged on opposite sides of the elongated structure that is to be entrenched in the trench to be formed.

23. Trenching apparatus according to claim 22 further comprising position determining means for determining the relative vertical positioning of said eductors to the elongated structure, said position determining means including warning means for generating a warning signal if said sled structure comes into contact with the elongated structure.

24. Trenching apparatus according to claim 18 wherein said sled structure includes two pontoons, each of said pontoons having a sufficiently high mass concentrated at its front end so that the center of gravity of said sled structure is approximately at the center of the longitudinal axis of said sled structure when said sled structure is out of the water.

25. Trenching apparatus according to claim 24 wherein: said frame includes an assembly pivotable about an axis lying adjacent to a plane along the front end of said sled structure and said pivotable assembly extending rearwardly along said sled structure; and said fluid jet excavating means and said spoil removal means are attached to said pivotable assembly so that said fluid jet excavating means and said spoil removal means are vertically adjustable with respect to said sled structure.

26. Trenching apparatus according to claims 18 or 25 wherein said spoil removal means includes two eductors for sucking up spoil excavated by said fluid jet excavating means and two discharge tubes each being coupled to a respective one of said eductors, said discharge tubes extending past the sides of said sled structure by approximately a distance L where $$L \geq \sqrt{20\,wd}$$

where w equals the average width of the trench to be excavated and d equals the depth of the trench to be excavated.

27. Trenching apparatus according to claim 26 wherein said discharge tube is sufficiently long so as to deposit the spoil created by the operation of said fluid jet excavating means and sucked up by said eductor at a sufficient distance to the side of said sled structure so that the spoil is unlikely to immediately reenter the trench being formed.

28. Trenching apparatus according to claims 19, 24 or 27 wherein said fluid jet excavating means includes at least one jet manifold tube having a plurality of output nozzles extending therefrom for directing water towards the surface to be excavated and said jet tube can be pivoted so that its upper end leans towards the front of said sled structure and the surface being excavated.

29. Trenching apparatus according to claim 28 wherein said nozzles are concentrated near the lower portion of said jet tube.

30. Trenching apparatus according to claims 18 or 26 further comprising flow detection means for detecting the flow through said spoil removal means and density detection means for detecting the density of the output spoil flowing through said spoil removal means.

31. An apparatus for entrenching a submerged, elongated structure such as a pipeline in the soil along the bottom of the sea, said apparatus comprising:

a sled structure capable of being towed along the sea bottom so as to straddle the elongated structure to be entrenched for excavating a trench along such elongated structure so that such elongated structure can eventally settle into the trench, said sled structure including: a frame; fluid jet excavating means mounted on said frame; spoil removal means mounted on said frame and located aft of said fluid jet excavating means, said spoil removal means including two eductors for sucking up spoil excavated by said fluid jet excavating means and two discharge tubes each being coupled to a respective one of said eductors, said discharge tubes extending past the sides of said sled structure by approximately a distance L where $$L \geq \sqrt{20\,wd}$$

where w equals the average width of a trench to be excavated and d equa the depth of a trench to be excavated; and, a towing vessel capable of moving along the water surface and having towing means coupled to said sled structure so that said towing vessel can tow said sled structure along the bottom.

32. Trenching apparatus according to claim 31 wherein said frame includes an assembly pivotable about an axis lying adjacent to a plane along the front end of said sled structure and said pivotable assembly extending rearwardly along said sled structure; and said fluid jet excavating means and said spoil removal means are attached to said pivotable assembly so that said fluid jet excavating means and said spoil removal means are vertically adjustable with respect to said sled structure.

33. Trenching apparatus according to claims 31 or 32 wherein said fluid jet excavating means is located adjacent to the rear end of said sled structure and said towing means is coupled to an upper front portion of said sled structure.

34. Trenching apparatus according to claim 31 wherein said fluid jet excavating means includes two jet tubes and each of said jet tubes and eductors are mounted on said frame so as to be capable of being arranged on opposite sides of the elongated structure that is to be entrenched in the trench to be formed.

35. Trenching apparatus according to claim 34 wherein said jet tubes and said eductors are capable of being extended in length in order to increase the depth of the trench formed during the excavation operation of said sled structure.

36. Trenching apparatus according to claim 31 wherein said sled structure includes two pontoons, each of said pontoons having a sufficiently high mass concentrated at its front ends so that the center of gravity of said sled structure is approximately at the center of the longitudinal axis of said sled structure when said sled structure is out of the water.

37. Trenching apparatus according to claim 36 wherein said fluid jet excavating means is mounted on said frame at a location adjacent to the rear end of said sled structure.

38. Trenching apparatus according to claim 31 further comprising guide rollers mounted on said frame for guiding said sled structure along the elongated structure and position determining means for determining the relative vertical positioning of said eductors to the elongated structure, said position determining means including a plurality of load cells housed within cylindrical casings and said cylindrical casings serving as the rotational axles for said guide rollers.

39. Trenching apparatus according to claims 33, 36 or 38 wherein said sled structure includes two pontoons, each of said pontoons having a sufficiently high mass concentrated at its front end so that the center of gravity of said sled structure is approximately at the center of the longitudinal axis of said sled structure when said sled structure is out of the water and said pontoons are constructed so as to automatically receive an increasing quantity of ballast when said sled structure is lowered through the water to the sea bottom and to automatically expel the ballast received when said sled structure is raised from the sea bottom to the water surface.

40. Trenching apparatus according to claim 39 wherein said fluid jet excavating means is located adjacent to the rear end of said sled structure.

41. Trenching apparatus according to claim 40 wherein said frame includes an assembly pivotable about an axis lying adjacent to a plane along a front end of said sled structure and said pivotable assembly extending rearwardly along said sled structure and said fluid jet excavating means and said spoil removal means are attached to said pivotable assembly so that said fluid jet excavating means and said spoil removal means are vertically adjustable with respect to said sled structure.

42. A sea sled for entrenching a submerged elongated structure such as a pipeline in the soil along the bottom of the sea, said sea sled being capable of being towed along the sea bottom so as to straddle the elongated structure to be entrenched for excavating a trench under such elongated structure so that such elongated structure can eventually settle into the trench, said sled structure comprising: a frame; fluid jet excavating means mounted on said frame and located adjacent to the rear end of said sled structure; spoil removal means mounted on said frame and located aft of said fluid jet excavating means, said spoil removal means causing soil excavated from the trench to be displaced to a location spaced to the side of said frame by a minimum distance dependent upon the volume of soil to be removed from the trench; said spoil removal means including at least one eductor for sucking up spoil excavated by said fluid jet excavating means and a discharge tube coupled to an output end of said eductor, said discharge tube extending past the side of said base structure by approximately a distance L where $$L \geq \sqrt{20\,wd}$$

where w equals the average width of the trench to be excavated and d equals the depth of the trench to be excavated; and said sled structure having its center of buoyancy and center of gravity located in front of said fluid jet excavating means so that said sled structure rides on substantially undisturbed soil on the sea bottom during the excavating operation.

43. A sea sled according to claim 42 further comprising towline connecting means for coupling a towing vessel to an upper front portion of said sea sled.

44. A sea sled according to claim 43 wherein the front end of said frame lies approximately adjacent to a plane along the front end of said sled structure and said frame has said towline connecting means at its front end.

45. A sea sled according to claims 42 or 44 further comprising position determining means for determining the relative angular and vertical positioning of said sled structure to the elongated structure being entrenched as said sled structure moves along the elongated structure and said position determining means including warning means for generating a warning signal if said sled structure comes into contact with the elongated structure.

46. A sea sled according to claim 42 wherein said fluid jet excavating means includes two jet tubes; said spoil removal means includes two eductors and two corresponding discharge tubes, each of said discharge tubes being coupled to an output of said corresponding eductor; and each of said jet tubes and eductors being mounted on said frame so as to be capable of being arranged on opposite sides of the elongated structure that is to be entrenched in the trench to be formed.

47. A sea sled according to claim 42 wherein said sled structure includes two pontoons, each of said pontoons having a sufficiently high mass concentrated at its front end so that the center of gravity of said sled structure is approximately in juxtaposition with the center of the longitudinal axis of said sled structure when said sled structure is out of the water.

48. A sea sled according to claim 47 wherein: said frame includes an assembly pivotable about an axis lying adjacent to a plane along the front end of said sled structure and said pivotable assembly extending rearwardly along said sled structure; and said fluid jet excavating means and said spoil removal means are attached to said pivotable assembly so that said fluid jet excavating means and said spoil removal means are vertically adjustable with respect to said sled structure.

49. A sea sled according to claim 42 or 48 wherein said spoil removal means includes two eductors for sucking up spoil excavated by said fluid jet excavating means and two discharge tubes each being coupled to a respective one of said eductors, said discharge tubes extending past the sides of said sled structure by approximately a distance L where $$L \geq \sqrt{20\,wd}$$

where w equals the average width of the trench to be excavated and d equals the depth of the trench to be excavated.

50. A sea sled according to claim 49 wherein said discharge tube is sufficiently long so as to deposit the spoil created by the operation of said fluid jet excavating means and sucked up by said eductor at a sufficient distance to the side of said sled structure so that the spoil is unlikely to immediately reenter the trench being formed.

51. A sea sled according to claim 42, 47 or 50 wherein said fluid jet excavating means includes at least one jet tube having a plurality of output nozzles extending therefrom for directing water towards the soil surface to be excavated and said jet tube can be pivoted so that its upper end leans towards the front end of said sled structure and the surface being excavated.

52. A sea sled according to claim 42 or 49 further comprising flow detection means for detecting the flow through said spoil removal means and density detection means for detecting the density of the output spoil flowing through said spoil removal means.

53. Sea sled for entrenching a submerged, elongated structure such as a pipeline in the soil along the bottom of the sea, said sled being capable of being towed along the sea bottom so as to straddle the elongated structure to be entrenched for excavating a trench along such elongated structure so that such elongated structure can eventually settle into the trench, said sled comprising: a pontoon structure; a frame mounted on said pontoon structure; fluid jet excavating means mounted on said frame; and spoil removal means mounted on said frame and located aft of said fluid jet excavating means, said spoil removal means including two eductors for sucking up spoil excavated by said fluid jet excavating means and two discharge tubes each being coupled to a respective one of said eductors, said discharge tubes extending past the sides of said pontoon structure by approximately a distance L where $$L \geq \sqrt{20\,wd}$$

where w equals the average width of the trench to be excavated and d the depth of a trench to be excavated.

54. A sled according to claim 53 wherein said frame includes an assembly pivotable about an axis lying adjacent to a plane along the front end of said sled and said pivotable assembly extending rearwardly along said sled; and said fluid jet excavating means and said spoil removal means are attached to said pivotable assembly so that said fluid jet excavating means and said spoil removal means are vertically adjustable with respect to said pontoon structure.

55. A sled according to claim 53 or 54 wherein said fluid jet excavating means is located adjacent to the rear end of said pontoon structure and said sled further comprising towline coupling means for coupling said sled from an upper front portion thereof to a towing vessel.

56. A sled according to claim 53 wherein said fluid jet excavating means includes two jet tubes and each of said jet tubes and eductors are mounted on said frame so as to be capable of being arranged on opposite sides of the elongated structure that is to be entrenched in the trench to be formed.

57. A sled according to claim 56 wherein said jet tubes and said eductors are capable of being extended in length in order to increase the depth of the trench formed during the excavation operation of said sled.

58. A sled according to claim 53 wherein said pontoon structure includes two pontoons, each of said pontoons having a sufficiently high mass concentrated at its front ends so that the center of gravity of said sled is approximately at the center of the longitudinal axis of said sled when said sled is out of the water.

59. A sled according to claim 58 wherein said fluid jet excavating means is mounted on said frame at a location adjacent to the rear end of said sled.

60. A sled according to claim 53 further comprising guide rollers mounted on said frame for guiding said sled along the elongated structure and position determining means for determining the relative vertical positioning of said eductors to the elongated structure, said position determining means being mounted in said guide rollers and including a plurality of load cells housed within cylindrical casings and said cylindrical casings serve as the rotational axles for said guide rollers.

61. A sled according to claim 53 wherein said pontoon structure includes two pontoons, each of said pontoons having a sufficiently high mass concentrated at its front end so that the center of gravity of said sled is approximately at the center of the longitudinal axis of said sled when said sled is out of the water and said pontoons are constructed so as to automatically receive an increasing quantity of ballast when said sled is lowered through the water to the sea bottom and to automatically expel the ballast received when said sled is raised from the sea bottom to the water surface.

62. A sled according to claim 61 wherein said fluid jet excavating means is located adjacent to the rear end of said sled.

63. A sled according to claim 62 wherein said frame includes an assembly pivotable about an axis lying adjacent to a plane along a front end of said sled and said pivotable assembly extending rearwardly along said sled and said fluid jet excavating means and said spoil removal means are attached to said pivotable assembly so that said fluid jet excavating means and said spoil removal means are vertically adjustable with respect to said sled.

64. A sea sled for entrenching a submerged elongated structure such as a pipeline in the soil along the bottom of the sea, said sea sled being capable of being towed along the sea bottom so as to straddle the elongated structure to be entrenched for excavating a trench under such elongated structure so that such elongated structure can eventually settle into the trench, said sled comprising:

a frame; fluid jet excavating means mounted on said frame; spoil removal means mounted on said frame and located aft of said fluid jet excavating means, said spoil removal means including a discharge tube for discharging soil excavated from the trench at a location spaced to the side of said frame, said discharge tube extending a minimum distance dependent upon the volume of soil to be removed from the trench; and said sled structure having its center of buoyancy and center of gravity located in front of said fluid jet excavating means so that said sled structure will ride on substantially undisturbed soil on the sea bottom during an excavating operation and having its center of gravity located approximately at its longitudinal center so that said sled structure will be balanced when said sled structure is suspended out of the water.

65. A sea sled according to claim 64 further comprising means for increasing the weight in the forward portion of said sled structure as said sled structure is lowered into the water to the sea bottom.

66. A sea sled according to claim 65 further comprising towline connecting means for coupling said sea sled from an upper portion thereof to a towing vessel.

67. A sea sled according to claim 66 wherein the front end of said frame lies approximately adjacent to a plane along the front end of said sled structure and said frame has said towline connecting means at its front end.

68. A sea sled according to claim 65 further comprising position determining means for determining the relative angular and vertical positioning of said sled structure to the elongated structure being entrenched as said sled structure moves along the elongated structure.

69. A sea sled according to claim 64 wherein said sled structure includes two pontoons, each of said pontoons having a sufficiently high mass concentrated at its front end so that the center of gravity of said sled structure is approximately at the center of the longitudinal axis of said sled structure when said sled structure is out of the water.

70. A sea sled according to claim 69 wherein: said frame includes an assembly pivotable about an axis lying adjacent to a plane along the front end of said sled structure and said pivotable assembly extending rearwardly along said sled structure; and said fluid jet excavating means and said spoil removal means are attached to said pivotable assembly so that said fluid jet excavating means and said spoil removal means are vertically adjustable with respect to said sled structure.

71. A sea sled according to claim 64 or 70 wherein said spoil removal means includes two eductors for sucking up spoil excavated by said fluid jet excavating means and two discharge tubes each being coupled to a respective one of said eductors, said discharge tubes extending past the sides of said sled structure by approximately a distance L where $$L \geq \sqrt{20\,wd}$$

where w equals the average width of the trench to be excavated and d equals the depth of the trench to be excavated.

72. A method for entrenching a pipeline in the soil along the bottom of the sea utilizing a trenching system including a sea sled having a pontoon structure, a frame mounted on the pontoon structure, a fluid jet excavating mechanism mounted on the frame at a location adjacent to the rear end of the sled and a spoil removal mechanism mounted on the frame at a location aft of the fluid jet excavating mechanism and a towing vessel capable of moving along the water surface having a towline connection mechanism for coupling the vessel to the sled and towing the sled along the sea bottom, the entrenching method comprising the steps of:

lowering the sled into the water to the sea bottom;

arranging the sled on the sea bottom in a position so as to straddle the pipeline to be entrenched;

excavating a trench under the pipeline so that the pipeline can eventually settle into the trench;

removing the excavated spoil from the trench and transporting such spoil through the spoil removal means by a distance L where $$L \geq \sqrt{20\,wd}$$

where w equals the average width of the trench and d equals the depth of the trench, before the spoil leaves the spoil removal mechanism; and towing the sled along the sea bottom.

73. A method according to claim 72 further comprising the step of increasing the ballast in the forward end of the sled as the sled is lowered through the water to the sea bottom.

74. A method according to claim 73 further comprising decreasing the ballast in the sled as the sled is lifted from the sea bottom back to the surface of the water.

75. A method according to claim 72, 73 or 74 further comprising the step of depositing the spoil removed from the trench at a sufficient distance away from the sides of the trench so that the spoil is unlikely to immediately reenter the trench being formed.

76. A method according to claim 72, 73 or 74 further comprising the step of determining the relative angular and vertical positioning of the sled with respect to the pipeline being entrenched as the sled moves along the pipeline and controlling the navigation of the towing vessel in response to information indicative of such determination regarding the positioning of the sled.

* * * * *

UNITED STATES PATENT AND TRADEMARK OFFICE

CERTIFICATE OF CORRECTION

PATENT NO. : 4,330,225

DATED : May 18, 1982

INVENTOR(S) : James S. Glasgow

It is certified that error appears in the above-identified patent and that said Letters Patent is hereby corrected as shown below:

In the Abstract, column 2, line 19, change "machanism" to --mechanism--.

Column 14, line 5, change "titled" to --tilted--.

Column 16, line 7, change "If" to --It--.

Column 16, line 14, change "soil" to --spoil--.

Column 16, line 40, claim 1, change "cn" to --can--.

Column 18, line 11, claim 2, change "taht" to --that--,

Column 19, line 1, claim 12, change "sid" to --said--.

Column 21, line 47, claim 31, change "equa" to --equals--.

Signed and Sealed this

*Thirtieth* Day of *August 1983*

[SEAL]

*Attest:*

GERALD J. MOSSINGHOFF

*Attesting Officer*

*Commissioner of Patents and Trademarks*